United States Patent [19]

Gyöngyös et al.

[11] 4,238,248

[45] Dec. 9, 1980

[54] PROCESS FOR PREPARING LOW EARING ALUMINUM ALLOY STRIP ON STRIP CASTING MACHINE

[75] Inventors: Ivan Gyöngyös, Männedorf; Kurt Buxmann; Martin Bolliger, both of Sierre; Willi Kerth, Flurlingen; Kurt Neufeld, Zürich, all of Switzerland

[73] Assignee: Swiss Aluminium Ltd., Chippis, Switzerland

[21] Appl. No.: 931,037

[22] Filed: Aug. 4, 1978

[51] Int. Cl.[3] ..... C22F 1/04

[52] U.S. Cl. ..... 148/2; 29/527.7; 148/11.5 A

[58] Field of Search ..... 148/2, 11.5 A; 29/527.7

[56] References Cited

U.S. PATENT DOCUMENTS 4,000,009 12/1976 Chatfield ..... 148/11.5 A

*Primary Examiner*—R. Dean

*Attorney, Agent, or Firm*—Bachman and LaPointe

[57] ABSTRACT

The present invention teaches a multi-stepped process for preparing high strength, improved formability, low earing strip stock which is especially suitable for the manufacture of deep drawn and ironed hollow bodies such as cans or the like. The process of the present invention is carried out in two distinct operations. The first operation comprises continuously casting an aluminum melt into strip form on a strip casting machine so as to produce a desired dendritic arm spacing, hot rolling the continuously cast strip at casting speed in a temperature range between 300° C. and the non-equilibrium solidus temperature of the alloy with the total reduction in excess of 70% and finally coiling the hot strip and allowing it to cool in air to room temperature so as to produce a metal strip having properties favorable for subsequent cold rolling operations. The second operation comprises an improved cold rolling operation in which a brief heat treatment at 350° C. to 500° C. for not more than 90 seconds is introduced between a first and second cold rolling operation.

30 Claims, 1 Drawing Figure

PROCESS FOR PREPARING LOW EARING ALUMINUM ALLOY STRIP ON STRIP CASTING MACHINE

BACKGROUND OF THE INVENTION

The present invention teaches a process for preparing strip stock from aluminum and aluminum alloys, preferbly Al-Mg-Mn alloys, by means of strip casting machines, wherein the strip exhibits low earing properties and is suitable for use in the manufacture of deep drawn and ironed hollow articles such as cans or the like.

In recent years Al-Mg-Mn alloys, in the form of cold rolled strip, have been successfully processed into beverage cans by deep drawing and ironing. A number of processes are known for the production of aluminum strip for use in these beverage cans. Typically, aluminum is cast by known methods such as horizontal and vertical direct chill casting, or strip casting for further treatment. One such known process is disclosed in U.S. Pat. No. 3,787,248 to Setzer et al. and assigned to the Assignee of the present invention. The process comprises casting an Al-Mg-Mn alloy, homogenizing this alloy at a temperature of between 455° C. to 620° C. for 2 to 24 hours, hot rolling from a starting temperature of 345° C. to 510° C. with a total reduction in thickness of at least 20%, subsequent rolling, starting from a temperature of 205° C. to 430° C. with reduction of at least 20%, subsequent rolling, starting from a temperature of less than 205° C. with reduction of at least 20%, heating the alloy between 95° C. and 230° C. for at least 5 seconds but no longer than a time determined by the equation $T(10+\log t)=12{,}500$, T standing for degrees Kelvin and t for maximum time in minutes.

While the process disclosed in the aforenoted patent has been used successfully for making metal strip to be used in the manufacture of cans, it has been found that strip produced by said process is not completely satisfactory in that the material experiences a high degree of earing.

A further known process for the production of strip is disclosed in *Light Metal Age*, Volume 33, 1975, December, Pages 28–33. In the aforenoted article the strip was prepared by a strip casting process and was thereafter treated so as to be useful in the manufacture of cans. One basic problem which arises in the production of strip via strip casting machines as disclosed in the above-noted article is that the dendritic arm spacing or cell size at the surface of the strip is too large. As a result of this large dendritic arm spacing, the strip exhibits extensive surface porosity which leads to cracks in the final rolled strip. In addition, when the dendritic arm spacing is too large, there is a danger of surface segregation which can lead to poor quality in the final rolled strip which in turn causes difficulties during the drawing and ironing operation.

Accordingly, it is a principal object of the present invention to provide a process for preparing aluminum alloy strip stock by means of a continuous strip casting machine which exhibits properties favorable for further processing by cold rolling.

It is a further object of the present invention to provide an improved process for cold rolling continuous strip cast stock to thereby improve the earing properties thereof.

It is still a further object of the present invention to provide the process as aforesaid which enables the aluminum alloy strip to be used in the production of cans and the like.

Further objects and advantages will appear hereinbelow.

SUMMARY OF THE INVENTION

In accordance with the present invention, the foregoing objects and advantages may be readily obtained.

The process of the present invention provides a high strength aluminum base alloy particularly Al-Mg-Mn alloys having improved earing properties and comprises:

A. continuously casting said alloy melt in strip form on a strip casting machine so as to obtain a dendritic arm spacing in the region of the surface of the as-cast strip from about 2 to 25 μm, preferably from about 5 to 15 μm and the dendritic arm spacing in the center of the strip is from about 20 to 120 μm, preferably from about 50 to 80 μm;

B. continuously hot rolling the cast strip at casting speed at a temperature range between 300° C. and the non-equilibrium solidus temperature of the alloy to a total reduction of at least 70%, whereby the temperature of the strip at the start of hot rolling is between said non-equilibrium solidus temperature and a temperature of about 150° C. below said non-equilibrium solidus temperature wherein the temperature of the strip at the end of the hot rolling is at least 280° C.;

C. hot coiling said strip whereby said coiled strip is allowed to cool to room temperature in air;

D. cold rolling said cooled strip in a first series of passes with a total reduction of at least 50%, preferably at least 65%;

E. flash annealing said cold rolled strip for not more than 90 seconds at a temperature of from about 350° C. to 500° C.; and F. cold rolling said strip in a second series of passes with a total reduction not to exceed 75%, preferably not to exceed 70%.

In the preferred embodiment, the cast strip of the present invention is cast on a strip casting machine having a plurality of continuously moving chilling blocks, as is known in the art, such that the cast strip after the start of solidification is held at a temperature between 400° C. and the liquidus temperature of the alloy for 2 to 15 minutes, preferably above 500° C. for preferably 10 to 50 seconds. By controlling the solidification rate the desired dendritic arm spacing as well as optimum distribution of insoluble heterogeneities is achieved. In addition, by controlling the cooling rate, homogenization treatments required in conventional processes can be eliminated due to the uniformity of composition of the as-cast strip.

The present invention resides in an improved process for casting aluminum and aluminum alloys, and in particular Al-Mg-Mn alloys wherein the total concentration of magnesium and manganese is from 2.0 to 3.3%, the ratio of magnesium to manganese is from 1.4:1 to 4.4:1 and the total concentration of other alloying elements and impurities is 1.5% maximum.

The process of the present invention lowers the cost of manufacturing aluminum strip by eliminating ingot casting, subsequent homogenization treatment, and the additional cost of hot rolling the large ingots.

DETAILED DESCRIPTION

Figure 1:
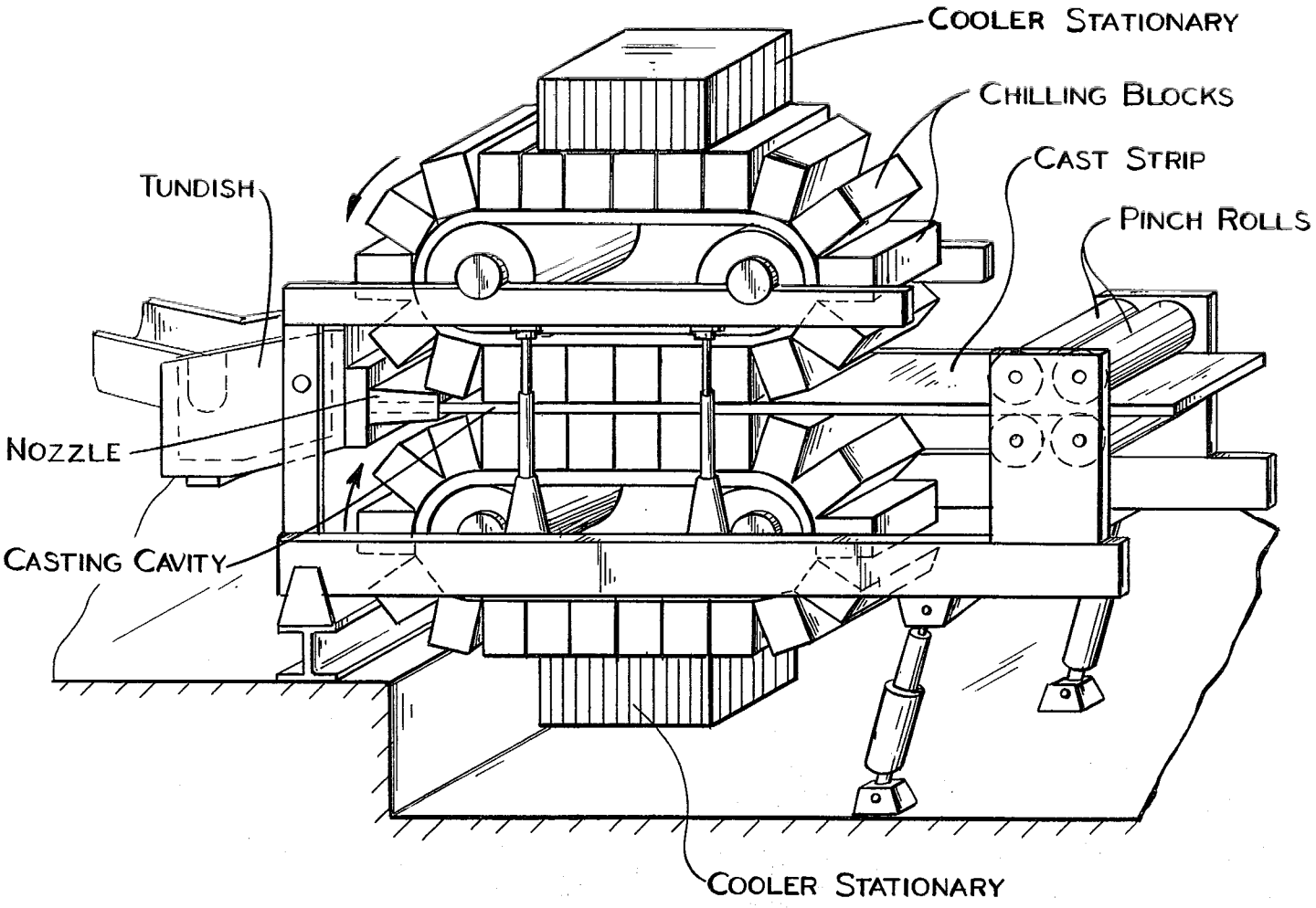
FIG. 1 is a schematic illustration of the strip casting machine used in the process of the present invention.

As indicated hereinabove, the present invention comprises a process for producing hot rolled aluminum sheet by a strip casting machine which is characterized by a preferred dendritic arm spacing and insoluble heterogeneity distribution which structures are essentially desirable when the strip is to be further processed by subsequent cold rolling operations. The present invention further comprises an improved cold rolling process for further processing the hot rolled strip which improve the earing properties thereof thus making the strip stock especially suitable for use in the production of deep drawn and ironed articles such as cans or the like.

FIG. 1 is a schematic illustration of the strip caster employed in the process of the present invention. The details of the strip caster employed in the present invention can be found in U.S. Pat. Nos. 3,709,281, 3,744,545, 3,759,313, 3,774,670 and 3,835,917 all of which are incorporated herein by reference. With reference to FIG. 1, two sets of chilling blocks are employed and rotate in opposite senses to form a casting cavity into which the aluminum alloy is brought through a thermally insulated nozzle system, not shown. The liquid metal upon contact with the chilling blocks is cooled and solidified. The strip of metal travels during this cooling and solidifying phase along with the chilling blocks until the strip exits the casting cavity where the chilling blocks lift off the cast strip and start the return path to a cooler where the chilling blocks are cooled before returning to the casting cavity.

It has been found that by controlling the cooling rate and thereby the rate of solidification of the cast strip as it passes through the casting cavity the desired dendritic and heterogeneity structure can be obtained. On cooling the aluminum alloy from the liquid state there are two important temperature ranges. The first temperature range being that temperature between the liquidus and the solidus of the aluminum alloy. The second temperature range being between the solidus and a temperature 100° C. below the solidus. The time taken to cool through the liquidus to solidus temperature range controls the average secondary dendrite arm spacing. While the time taken to cool in the range of the solidus temperature to a point 100° C. below the solidus temperature eliminates to a large extent nonuniformities in the as-cast strip by controlling the rounding of the heterogeneities in the as-cast structure, the equalization or distribution of the heterogeneities and the transformation of non-equilibrium phases to equilibrium phases.

The rate of cooling as the cast strip passes through the casting cavity of the strip casting machine illustrated in FIG. 1 is controlled by controlling various process and product parameters. These parameters include material cast, strip gauge, chill block material, length of casting cavity, casting speed and efficiency of the chill block cooling system.

It is a surprising advantage of the process of the present invention that this process imparts significant improved physical characteristics to the aluminum material processed characterized by improved strength and earing properties. These characteristics will be discussed in greater detail hereinbelow.

As an example of the foregoing, conventional materials currently used in the production of strip include Aluminum Alloy 3004. Alloy 3004 having the following composition has been found to be particularly suitable for use in the process of the present invention: magnesium from 0.8 to 1.3%, magnanese from 1.0 to 1.5%, iron up to 0.7%, silicon up to 0.3%, copper up to 0.25%, zinc up to 0.25%, balance essentially aluminum. The processing of the present invention achieves superior properties in 3004 than that obtained by conventional processes. A particular advantage of the material processed in accordance with the present invention is its superior strength and improved earing properties over the same material processed in a conventional manner.

Other alloys which are particularly suitable for use in the process of the present invention are characterized by having a total concentration of magnesium and manganese from 2.0 to 3.3% while maintaining the ratio of magnesium to manganese from 1.4:1 to 4.4:1 and maintaining the total concentration of other alloying elements to 1.5% maximum. It has been found that when these alloys are processed in accordance with the present invention, they exhibit superior earing properties as well as deep drawing properties at least as good as conventional Al-Mg-Mn alloys in spite of the high concentration of solid solution strengthening elements, magnesium and manganese. It is preferred that the total magnesium and manganese concentration be between 2.3 and 3.0% thus resulting in the combined solid solution strengthening influence of magnesium and manganese to approximate that of the magnesium addition in the 5000 series aluminum alloy. In addition, it is preferred that the ratio of magnesium to manganese is kept in the range of 1.8:1 to 3.0:1. Preferred additional alloying elements include copper up to 0.3%, silicon from 0.1 to 0.5%, iron from 0.1 to 0.65%, titanium and/or vanadium up to 0.15%, with the total additional alloying elements and impurities not to exceed 1.5%.

The surprising advantage of the present invention is that it enables strip stock to be made from alloys containing a high concentration of solid solution strengthening elements while maintaining excellent deep drawing properties as well as improving the earing properties thereof. It is a particular advantage that material processed in accordance with the present invention exhibit superior earing, strength and deep drawing properties over the same material processed in a conventional manner.

In accordance with the process of the present invention, the aluminum alloys utilized herein are continuously cast into strip form on a strip casting machine having continuously moving chilling blocks such that the dendritic arm spacing in the region of the as-cast strip is between 2 and 25 μm, preferably between 5 and 15 μm, and the dentritic arm spacing in the center region of the strip is between 20 to 120 μm, preferably between 50 and 80 μm. In accordance with the process of the present invention, in order to achieve the aforenoted preferred dendritic structure as well as uniformity in the composition of the cast strip in the alloys utilized herein, it has been found favorable in the process of the present invention to keep the cast strip after the start of solidification to the start of hot rolling at a temperature of between 400° C. and the liquidus temperature of the cast alloy for 2 to 15 minutes, preferably above 500° C. for preferably 10 to 50 seconds. By controlling the cooling rate at the start of solidification of the cast strip, the desired dendritic arm spacing is readily obtained. It has also been found that as a result of the relatively slow cooling rate achieved by the process of the present invention there is an optimum distribution of insoluble heterogeneities within the cast strip, a feature which is favorable in connection with subsequent cold rolling. As a result of the relatively long time the solidified strip spends at high temperatures the heat contained in the as-cast strip promotes diffusion controlled processes in the structure which results in eliminating non-uniformities by spheroidication and rounding of the heterogeneities, equalization of the micro-segregation, i.e., coring and transformation of non-equilibrium phases to equilibrium phases. Thus, by the strip casting process of the present invention the normal homogenization treatment required in conventional processes can be eliminated.

The process of the present invention comprises a series of hot rolling steps which fall into critical temperature limits. In accordance with the process of the present invention the cast strip is hot rolled continuously at the casting speed, with additional heating being applied thereto if desired, in a temperature range between 300° C. and the non-equilibrium solidus temperature of the alloy with a total reduction of thickness of at least 70%, whereby the temperature of the strip at the start of hot rolling is between the non-equilibrium solidus temperature and a temperature 150° C. below the non-equilibrium solidus temperature and the temperature of the strip at the end of hot rolling is at least 280° C. It has been found in order to minimize undesirable properties, particularly excessive earing which would result from direct processing of the cast strip into finished products such as cans or the like, special attention must be given to insure that the hot working takes place at a sufficiently high temperature, preferably above 440° C. and ideally about 490° C. Only hot working in accordance with the process of the present invention at the required temperature and with the required amount of forming will guarantee adequate working of the strip material so as to enable the elimination of a homogenization strip without impairing the quality of the end product. As previously noted, only an amount of hot forming of at least 70% can guarantee the same favorable products in the end product, i.e., strip stock as can be achieved with conventional methods.

One of the essential steps in the process according to the present invention is the hot coiling of the cast strip after it has been hot worked, and the cooling down of the hot rolled coil in air to room temperature. As previously noted above, the temperature of the strip at the end of hot rolling should be at least 280° C. and preferably at least 300° C. It has been found that when the hot strip is coiled and allowed to cool in air to room temperature, the heat stored in the coils allows precipitation of the intermetallic phases which slowly precipitate out and at the same time brings about a softening of the strip which is favorable for subsequent cold rolling. In addition, a certain degree of recrystallization occurs in this stage of the process which, due to a reduction in the amount of rolling texture, has a favorable effect in reducing the earing at 45° to the rolling direction when the strip is further processed into cans or the like.

The coiled strip as cast according to the process of the present invention as described above is at a gauge selected to give the finished gauge after appropriate rolling. The cold rolling operation may be carried out in any known manner.

In accordance with the process of the present invention, it has been found particularly advantageous to introduce an intermediate flash anneal at 350° C. to 500° C. during cold rolling whereby in the cold rolling to final thickness after the intermediate anneal a reduction of at most 75%, preferably at most 70% is carried out. The process comprises the following steps:

A. cold rolling in a first series of passes with a total reduction of at least 50%, preferably at least 65%;

B. subjecting the cold rolled strip to a brief flash anneal at a temperature between 350° C. to 500° C. for not more than 90 seconds; and C. cold rolling in a second series of passes with a total reduction of at most 75%, preferably at most 70%.

It has been found that due to the brief flash anneal, in particular with strip produced by strip casting as described above, the amount of earing at 45° to the rolling direction in the finished strip is substantially reduced. A decrease in the amount of earing during subsequent drawing and ironing operations is particularly advantageous in that the ironing step can proceed symmetrically and is not influenced by asymmetry due to excessive earing.

It has been found that the intermediate flash anneal in accordance with the process of the present invention is superior when compared with the normal conventional anneal involving slow heating up, slow cooling down, and long holding times. It has been found that the brief flash anneal, (A) reduces the rolling texture in the cold rolled strip to a greater extent than is accomplished with conventional annealing and, (B) at the same time results in a smaller loss of strength than that which occurs from the conventional processing. As a result of feature A described above, the second series of cold rolling passes which brings the strip to final gauge is carried out with less pronounced rolling texture and can, as a result of feature B, be carried out with less hard working thus resulting in an overall less pronounced rolling texture. As is well known, a smaller amount of rolling texture results in a smaller amount of earing at 45° to the rolling direction. In accordance with the process of the present invention the time and temperature of intermediate flash anneal are interdependent. It can be determined in accordance with the equation $\ln t=(A/T)-C$ where, t is the time and seconds, T is the temperature degrees Kelvin and A and C are constants. The interdependency between the time and temperature is such that the higher the temperature of the flash anneal the shorter the amount of time required. In the preferred embodiment of the present invention, the duration of the intermediate flash anneal is preferably at most 90 seconds including heating up, holding at temperature and cooling down. It is preferred that when carrying out the intermediate anneal in the process of the present invention heat up be not more than 30 seconds and preferably 4 to 15 seconds, holding the strip at temperature for preferably between 3 to 30 seconds and cooling the strip to room temperature within 25 seconds.

The process of the present invention will be more readily understandable from a consideration of the following illustrative examples.

EXAMPLE I

As previously noted, on cooling from the liquid state there are two important temperature ranges, the temperature between the liquidus and solidus, $\Delta T_{L/S}$, and the temperature range between the solidus and a temperature 100° C. below the solidus $\Delta T_{S/S-100°}$ C. The time taken to cool through the range $\Delta T_{L/S}$ controls average dendritic arm spacing while the time spent in the region $\Delta T_{S/S-100°}$ C. controls the rounding of the heterogeneities in the as-cast structure, equalization of the microstructure and the transformation of non-equilibrium phases to equilibrium phases.

Aluminum Alloy 3004 was provided and was cast in accordance with both the strip casting process according to the present invention and conventional direct chill casting. In accordance with the present invention the strip was cast on a casting machine similar to that shown in FIG. 1 wherein the casting speed was 3 meters per minute. The temperature of the strip at the start of solidification was 650° C., the temperature falling to 500° C. after 35 seconds and reaching a temperature of 400° C. after 6 minutes. The cell size of the strip as cast is illustrated in Table I, the times spent in each of the temperature ranges listed in Table I was roughly estimated from the measurement of the cell size. Another melt of Alloy 3004 was cast by the conventional direct chill casting method. The surface of the direct chilled cast ingots was scalped so as to remove non-uniformities in the composition from the outer surface of the ingot. As previous noted, Table I set forth below was the dendritic arm spacing obtained on the surface and in the center of the as-cast alloy for both the process of the present invention and the conventional direct chill cast process. The $\Delta T_{L/S}$ and $\Delta T_{S/S-100°}$ C. values have been calculated from the measurement of the dendritic arm spacing.

TABLE I

| Sample | Cell Size (μm) | $\Delta T_{L/S}$ (sec) | $\Delta T_{S/S\text{-}100°\ C.}$ (sec) |
|---|---|---|---|
| Surface of strip cast in accordance with the present invention | 15 | 5 | 120 |
| Center of strip cast in accordance with the present invention | 50 | 20 | 120 |
| Direct chill cast, surface (scalped) | 30 | 15 | 5 |
| Direct chill cast, center | 70 | 80 | 15 |

As can be seen from Table I, the strip cast in accordance with the process of the present invention spends a longer time in temperature range where diffusion controlled transformations are possible than is the case with conventional direct chill casting. For this reason, the transformations involved progressed much more in the structure of the strip casting than in the structure produced by conventional direct chill casting. In addition, the strip cast in accordance with the process of the present invention has undergone a larger amount of homogenization than the direct chill cast. In particular, at the surface of the as-cast strip, the diffusion controlled transformations effecting the equalization of concentration differences is especially advanced since these transformations proceed faster the finer the dendritic arm spacing. This distinguishes the final dendritic arm spacing of the strip of the present invention from the coarser structure obtained from direct chill casting.

EXAMPLE II

Two Al-Mg-Mn alloys were provided having the compositions set forth in Table II below.

TABLE II

| | Mg | Mn | Cu | Si | Fe | Al |
|---|---|---|---|---|---|---|
| A | 0.90% | 0.96% | 0.90% | 0.18% | 0.58% | Balance |
| B | 1.86% | 0.66% | 0.04% | 0.23% | 0.39% | Balance |

Two samples of both Alloys A and E were cast as 20 mm thick strip in a strip casting machine, hot rolled in two passes in line with the caster and then coiled hot in accordance with the process of the present invention. The first pass was made at a starting temperature of 550° C. to a finished temperature of 440° C. with reduction of thickness of the strip from 20 mm to 6 mm. The second pass was made at a starting temperature of 360° C. to a finished temperature of 320° C. with a reduction in thickness from 6 mm to 3 mm. Table III below lists the 0.2% offset yield strength and the ultimate tensile strength for the hot rolled strip for both Alloys A and B.

TABLE III

| | 0.2% Yield Strength | Ultimate Tensile Strength |
|---|---|---|
| A | 130 MPa | 210 MPa |
| B | 140 MPa | 220 MPa |

Strip A was then cold rolled with reduction from 3 mm to 1.05 mm and Strip B was clod rolled with reduction from 3 mm to 0.65 mm. Both strips were given an intermediate anneal at 425° C. before being cold rolled to a final gauge of 0.34 mm. One sample of each Alloy A and B were subjected to conventional intermediate anneal where heat up time was approximately 10 hours and the strip was held for one hour at 425° C. with a cooling down of 3 hours. The second samples of each alloy were flash annealed in accordance with the process of the present invention. The alloy strips were held for 10 seconds at 425° C. with a heat up time of 15 seconds and a cooling down time of 15 seconds. Both annealing treatments as set forth above produce complete recrystallization of the strip. Table IV below lists the 0.2% yield strength and earing values obtained for each of the samples after annealing and prior to cold rolling to final thickness of 0.34 mm.

TABLE IV

| | | 0.2% Yield Strength | | |
|---|---|---|---|---|
| | Intermediate Anneal | Before cold rolling to 0.34 mm | After cold rolling to 0.34 mm | Earing |
| A | (a) | 71 MPa | 261 MPa | 3.0% |
| | (b) | 87 MPa | 274 MPa | 2.4% |
| B | (a) | 88 MPa | 266 MPa | 1.8% |
| | (b) | 104 MPa | 278 MPa | 1.2% |

It is clearly seen from Table IV that the brief flash anneal in accordance with the process of the present invention produces lower earing values in spite of higher strength than does the conventional anneal.

EXAMPLE III

The cold rolling passes were chosen such that after the flash anneal treatment of the present invention the same final strength was obtained as after the conventional intermediate anneal so as to show that the reduction in the earing by the process of the present invention is even more striking. To illustrate the point Strip A was cold rolled from 3 mm to 0.8 mm and Strip B from 3 mm to 0.52 mm. Both strips were then subjected to the flash anneal treatment described above in accordance with the present invention. Strips A and B were then cold rolled to a final thickness of 0.34 mm. The results that are set forth in Table V show that when the cold rolling passes are chosen so as to obtain the same yield strength as was obtained by conventional processing as set forth in Example II, Table I of the improvement in earing values of the material processed in accordance with the present invention, is even more striking.

TABLE V

| | 0.2% Yield Strength (After cold rolling to 0.34 mm) | Earing |
|---|---|---|
| A | 261 MPa | 1.9% |
| B | 266 MPa | 0.9% |

Three samples of the same alloy designated Alloy B in Table II of Example II were processed in accordance with Example II to produce a 3 mm thick hot rolled strip. The strip was then cold rolled with reduction from 3 mm to 0.65 mm. Each sample was then annealed using three different treatments after which each sample was cold rolled to an 85% reduction to final thickness. One sample was treated at 350° C. for 20 seconds, the second was treated at 425° C. for 20 seconds and the third was treated at 425° C. for one hour. Table VI below lists the 0.2% yield strength and tensile strength of the material for the three different anneal treatments.

TABLE VI

| Intermediate Anneal | 0.2% Yield Strength | Ultimate Tensile Strength |
|---|---|---|
| 350° C./20 s | 336 MPa | 341 MPa |
| 425° C./20 s | 331 MPa | 339 MPa |
| 425° C./1 h | 334 MPa | 340 MPa |

Finally, in order to simulate stove lacquering, i.e., when stock for can bodies are coated with a polymeric layer to prevent direct contact between the alloy container and the material contained therein, each sample of the material was given a treatment at a temperature of 190° C. for 8 minutes which is typical for curing the polymeric coating. This heat treatment tends to produce a partial softening in the alloy. The strength losses after this treatment are given in Table VII hereinbelow with details of the corresponding intermediate anneal.

TABLE VII

| Intermediate Anneal | Loss of 0.2% Yield Strength | Loss of Ultimate Tensile Strength |
|---|---|---|
| 350° C./20 s | 18 MPa | 0 MPa |
| 425° C./20 s | 40 MPa | 15 MPa |
| 425° C./1 h | 55 MPa | 40 MPa |

As can be seen from Table VII the brief heat treatments in accordance with the process of the present invention produce a much smaller loss of strength than the conventional intermediate anneals which are at 45° C.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A multi-stepped process for fabricating high strength, improved formability, low earing aluminum strip stock from an aluminum melt comprising:
   (A) continuously casting said aluminum melt in strip form;
   (B) holding said casting strip at casting speed after the start of solidification at a temperature between 400° C. and the liquidus temperature of the alloy for about 2 to 15 minutes prior to hot rolling so as to obtain a preferred dendritic arm spacing;
   (C) continuously hot rolling the cast strip at casting speed at a temperature range between 300° C. and the non-equilibrium solidus temperature of the alloy to a total reduction of at least 70%; and
   (D) hot coiling said hot rolled strip wherein said coiled strip is allowed to cool in air to room temperature prior to further working.

2. A multi-stepped process for fabricating high strength, improved formability, low earing aluminum strip stock from an aluminum melt comprising:
   (A) continuously casting said aluminum melt in strip form so as to obtain a preferred dendritic arm spacing;
   (B) continuously hot rolling the cast strip at casting speed at a temperature range between 300° C. and the non-equilibrium soldius temperature of the alloy to a total reduction of at least 70%;
   (C) hot coiling said hot rolled strip wherein said coiled strip is allowed to cool in air to room temperature prior to further working;
   (D) cold rolling said cooled hot rolled strip in a first series of passes to a strip of intermediate gauge;
   (E) flash annealing said cold rolled strip for not more than 90 seconds at a temperature of from about 350° C. to about 500° C.; and
   (F) cold rolling said annealed strip in a second series of passes to final gauge.

3. A multi-stepped process for fabricating high strength, improved formability, low earing aluminum strip stock from an aluminum melt comprising:
   (A) continuously casting said aluminum melt in strip form;
   (B) holding said cast strip at casting speed after the start of solidification at a temperature between 500° C. and the liquidus temperature of the alloy for from about 10 to 50 seconds prior to hot rolling so as to obtain a preferred dendritic arm spacing;
   (C) continuously hot rolling the cast strip at casting speed at a temperature range between 300° C. and the non-equilibrium solidus temperature of the alloy to a total reduction of at least 70%; and
   (D) hot coiling said hot rolled strip wherein said coiled strip is allowed to cool in air to room temperature prior to further working.

4. A multi-stepped process for fabricating high strength, improved formability, low earing aluminum strip stock from an alumnum melt comprising:
   (A) continuously casting said aluminum melt in strip form;
   (B) holding said cast strip at casting speed after the start of solidification at a temperature between 500° C. and the liquidus temperature of the alloy for from about 10 to 50 seconds prior to hot rolling so as to obtain a preferred dendritic arm spacing;

(C) continuously hot rolling said cast strip at casting speed at a temperature range between 300° C. and the non-equilibrium solidus temperature of the alloy to a total reduction of at least 70%, the temperature of the strip at the start of hot rolling being between said non-equilibrium solidus temperature and a temperature of about 150° below said non-equilibrium solidus temperature wherein the temperature of the strip at the end of hot rolling is at least 280° C.;

(D) immediately hot coiling said hot rolled strip wherein said coiled strip is allowed to cool in air to room temperature;

(E) cold rolling said cooled hot rolled strip in a first series of passes to an intermediate gauge of at least 50% reduction in thickness;

(F) flash annealing said cold rolled strip for not more than 90 seconds at a temperature of from about 350° C. to about 500° C.; and (G) cold rolling said annealed strip in a second series of passes to a final gauge having a total reduction of at least 65%.

5. The process of claim 1 wherein said preferred dendritic arm spacing in the region of the surface of the as-cast strip is from about 2 to 25 μm, and the dendritic arm spacing in the center of the strip is from about 20 to 120 μm.

6. The process of claim 1 wherein said preferred dendritic arm spacing in the region of the surface of the as-cast strip is from about 5 to 15 μm and the dendritic arm spacing in the center of the strip is from about 50 to 80 μm.

7. The process of claim 1 wherein the temperature of the strip at the start of hot rolling is between said non-equilibrium solidus temperature and a temperature of about 150° C. below said non-equilibrium solidus temperature wherein the temperature of the strip at the end of the hot rolling is at least 280° C.

8. The process of claim 1 wherein said continuously hot rolling of said cast strip at casting speed takes place at a temperature above 440° C.

9. The process of claim 1 wherein said continuously hot rolling of said cast strip at casting speed takes place at a temperature above 490° C.

10. The process of claim 7 wherein the temperature of the strip at the end of hot rolling is preferably at least 300° C.

11. The process of claim 2 wherein said cold rolling to said intermediate gauge comprises at least a 50% reduction in thickness.

12. The process of claim 2 wherein said cold rolling to said final gauge comprises a total reduction of at least 65%.

13. The process of claim 2 wherein said cold rolling to said final gauge comprises a total reduction not to exceed 75%.

14. The process of claim 2 wherein said cold rolling of said strip to said final gauge comprises a total reduction not to exceed 70%.

15. The process of claim 2 wherein said flash anneal comprises a heat up time not to exceed 30 seconds, holding the strip at temperature for between about 3 to 30 seconds and cooling the strip to room temperature with 25 seconds.

16. The process of claim 15 wherein said heat up is preferably between 4 to 15 seconds.

17. The process of claim 2 wherein said cold rolling to said final gauge comprises a total reduction of from about 65% to 70%.

18. A process for fabricating high strength, improved formability low earing aluminum strip stock from hot rolled aluminum strip comprising:

(A) cold rolling said hot rolled strip in a first series of passes to an intermediate gauge;

(B) flash annealing said cold rolled strip for not more than 90 seconds at a temperature of from about 350° C. to 500° C.; and (C) cold rolling said flash annealed strip in a second series of passes to final gauge.

19. The process of claim 18 wherein said cold rolling to said intermediate gauge comprises at least a 50% reduction in thickness.

20. The process of claim 18 wherein said cold rolling to said final gauge comprises a total reduction of at least 65%.

21. The process of claim 18 wherein said cold rolling to said final gauge comprises a total reduction not to exceed 75%.

22. The process of claim 18 wherein said cold rolling of said strip to said final gauge comprises a total reduction not to exceed 70%.

23. The process of claim 18 wherein said flash anneal comprises a heat up time not to exceed 30 seconds, holding the strip at temperature for between 3 to 30 seconds and cooling the strip to room temperature within 25 seconds.

24. The process of claim 23 wherein said heat up is preferably between 4 to 15 seconds.

25. The process of claim 18 wherein said cold rolling to said final gauge comprises a total reduction of from about 65% to 70%.

26. A multi-stepped process for fabricating high strength, improved formability, low earing aluminum strip block from an aluminum melt comprising:

(A) continuously casting said aluminum melt in strip form;

(B) holding said cast strip at casting speed after the start of solidification at a temperature between 400° C. and the liquidus temperature of the alloy for about 2 to 15 minutes so as to obtain a preferred dendritic arm spacing;

(C) continuously hot rolling said cast strip at casting speed at a temperature range between 300° C. and the non-equilibrium solidus temperature of the alloy to a total reduction of at least 70%, the temperature of the strip At the start of hot rolling being between said non-equilibrium solidus temperature and a temperature of about 150° below said non-equilibrium solidus temperature wherein the temperature of the strip at the end of hot rolling is at least 280° C.;

(D) immediately hot coiling said hot rolled strip wherein said coiled strip is allowed to cool in air to room temperature;

(E) cold rolling said cooled hot rolled strip in a first series of passes to an intermediate gauge of at least 50% reduction in thickness;

(F) flash annealing said cold rolled strip for not more than 90 seconds at a temperature of from about 350° C. to about 500° C.; and (G) cold rolling said annealed strip in a second series of passes to a final gauge having a total reduction of at least 65%.

27. The process of claim 26 wherein said preferred dendritic arm spacing in the region of the surface of the as-cast strip is from about 2 to 25 μm, and the dendritic arm spacing in the center of the strip is from about 20 to 120 μm.

28. The process of claim 4 wherein the temperature of the strip at the end of hot rolling is preferably at least 300° C.

29. The process of claim 28 wherein said flash anneal comprises a heat up temperature not to exceed 30 seconds, holding the strip at temperature for between about 3 to 30 seconds and cooling the strip to room temperature within 25 seconds.

30. The process of claim 29 wherein said cold rolling to said final gauge comprises a total reduction of from about 65% to 70%.

* * * * *

UNITED STATES PATENT AND TRADEMARK OFFICE

CERTIFICATE OF CORRECTION

PATENT NO. : 4,238,248

DATED : December 9, 1980

INVENTOR(S) : Ivan Gyongyos et al.

It is certified that error appears in the above—identified patent and that said Letters Patent is hereby corrected as shown below:

In The Grant Only, insert columns 9, 10, 11 and 12, as per attachment.

Signed and Sealed this

*Twenty-eighth* Day of *April 1981*

[SEAL]

*Attest:*

RENE D. TEGTMEYER

*Attesting Officer*

*Acting Commissioner of Patents and Trademarks* to 0.52 mm. Both strips were then subjected to the flash anneal treatment described above in accordance with the present invention. Strips A and B were then cold rolled to a final thickness of 0.34 mm. The results that are set forth in Table V show that when the cold rolling passes are chosen so as to obtain the same yield strength as was obtained by conventional processing as set forth in Example II, Table I of the improvement in earing values of the material processed in accordance with the present invention, is even more striking.

TABLE V

| | 0.2% Yield Strength (After cold rolling to 0.34 mm) | Earing |
|---|---|---|
| A | 261 MPa | 1.9% |
| B | 266 MPa | 0.9% |

Three samples of the same alloy designated Alloy B in Table II of Example II were processed in accordance with Example II to produce a 3 mm thick hot rolled strip. The strip was then cold rolled with reduction from 3 mm to 0.65 mm. Each sample was then annealed using three different treatments after which each sample was cold rolled to an 85% reduction to final thickness. One sample was treated at 350° C. for 20 seconds, the second was treated at 425° C. for 20 seconds and the third was treated at 425° C. for one hour. Table VI below lists the 0.2% yield strength and tensile strength of the material for the three different anneal treatments.

TABLE VI

| Intermediate Anneal | 0.2% Yield Strength | Ultimate Tensile Strength |
|---|---|---|
| 350° C./20 s | 336 MPa | 341 MPa |
| 425° C./20 s | 331 MPa | 339 MPa |
| 425° C./1 h | 334 MPa | 340 MPa |

Finally, in order to simulate stove lacquering, i.e., when stock for can bodies are coated with a polymeric layer to prevent direct contact between the alloy container and the material contained therein, each sample of the material was given a treatment at a temperature of 190° C. for 8 minutes which is typical for curing the polymeric coating. This heat treatment tends to produce a partial softening in the alloy. The strength losses after this treatment are given in Table VII hereinbelow with details of the corresponding intermediate anneal.

TABLE VII

| Intermediate Anneal | Loss of 0.2% Yield Strength | Loss of Ultimate Tensile Strength |
|---|---|---|
| 350° C./20 s | 18 MPa | 0 MPa |
| 425° C./20 s | 40 MPa | 15 MPa |
| 425° C./1 h | 55 MPa | 40 MPa |

As can be seen from Table VII the brief heat treatments in accordance with the process of the present invention produce a much smaller loss of strength than the conventional intermediate anneals which are at 45° C.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A multi-stepped process for fabricating high strength, improved formability, low earing aluminum strip stock from an aluminum melt comprising:
   (A) continuously casting said aluminum melt in strip form;
   (B) holding said casting strip at casting speed after the start of solidification at a temperature between 400° C. and the liquidus temperature of the alloy for about 2 to 15 minutes prior to hot rolling so as to obtain a preferred dendritic arm spacing;
   (C) continuously hot rolling the cast strip at casting speed at a temperature range between 300° C. and the non-equilibrium solidus temperature of the alloy to a total reduction of at least 70%; and
   (D) hot coiling said hot rolled strip wherein said coiled strip is allowed to cool in air to room temperature prior to further working.

2. A multi-stepped process for fabricating high strength, improved formability, low earing aluminum strip stock from an aluminum melt comprising:
   (A) continuously casting said aluminum melt in strip form so as to obtain a preferred dendritic arm spacing;
   (B) continuously hot rolling the cast strip at casting speed at a temperature range between 300° C. and the non-equilibrium soldius temperature of the alloy to a total reduction of at least 70%;
   (C) hot coiling said hot rolled strip wherein said coiled strip is allowed to cool in air to room temperature prior to further working;
   (D) cold rolling said cooled hot rolled strip in a first series of passes to a strip of intermediate gauge;
   (E) flash annealing said cold rolled strip for not more than 90 seconds at a temperature of from about 350° C. to about 500° C.; and
   (F) cold rolling said annealed strip in a second series of passes to final gauge.

3. A multi-stepped process for fabricating high strength, improved formability, low earing aluminum strip stock from an aluminum melt comprising:
   (A) continuously casting said aluminum melt in strip form;
   (B) holding said cast strip at casting speed after the start of solidification at a temperature between 500° C. and the liquidus temperature of the alloy for from about 10 to 50 seconds prior to hot rolling so as to obtain a preferred dendritic arm spacing;
   (C) continuously hot rolling the cast strip at casting speed at a temperature range between 300° C. and the non-equilibrium solidus temperature of the alloy to a total reduction of at least 70%; and
   (D) hot coiling said hot rolled strip wherein said coiled strip is allowed to cool in air to room temperature prior to further working.

4. A multi-stepped process for fabricating high strength, improved formability, low earing aluminum strip stock from an alumnum melt comprising:
   (A) continuously casting said aluminum melt in strip form;
   (B) holding said cast strip at casting speed after the start of solidification at a temperature between 500° C. and the liquidus temperature of the alloy for from about 10 to 50 seconds prior to hot rolling so as to obtain a preferred dendritic arm spacing;

(C) continuously hot rolling said cast strip at casting speed at a temperature range between 300° C. and the non-equilibrium solidus temperature of the alloy to a total reduction of at least 70%, the temperature of the strip at the start of hot rolling being between said non-equilibrium solidus temperature and a temperature of about 150° below said non-equilibrium solidus temperature wherein the temperature of the strip at the end of hot rolling is at least 280° C.;

(D) immediately hot coiling said hot rolled strip wherein said coiled strip is allowed to cool in air to room temperature;

(E) cold rolling said cooled hot rolled strip in a first series of passes to an intermediate gauge of at least 50% reduction in thickness;

(F) flash annealing said cold rolled strip for not more than 90 seconds at a temperature of from about 350° C. to about 500° C.; and (G) cold rolling said annealed strip in a second series of passes to a final gauge having a total reduction of at least 65%.

5. The process of claim 1 wherein said preferred dendritic arm spacing in the region of the surface of the as-cast strip is from about 2 to 25 μm, and the dendritic arm spacing in the center of the strip is from about 20 to 120 μm.

6. The process of claim 1 wherein said preferred dendritic arm spacing in the region of the surface of the as-cast strip is from about 5 to 15 μm and the dendritic arm spacing in the center of the strip is from about 50 to 80 μm.

7. The process of claim 1 wherein the temperature of the strip at the start of hot rolling is between said non-equilibrium solidus temperature and a temperature of about 150° C. below said non-equilibrium solidus temperature wherein the temperature of the strip at the end of the hot rolling is at least 280° C.

8. The process of claim 1 wherein said continuously hot rolling of said cast strip at casting speed takes place at a temperature above 440° C.

9. The process of claim 1 wherein said continuously hot rolling of said cast strip at casting speed takes place at a temperature above 490° C.

10. The process of claim 7 wherein the temperature of the strip at the end of hot rolling is preferably at least 300° C.

11. The process of claim 2 wherein said cold rolling to said intermediate gauge comprises at least a 50% reduction in thickness.

12. The process of claim 2 wherein said cold rolling to said final gauge comprises a total reduction of at least 65%.

13. The process of claim 2 wherein said cold rolling to said final gauge comprises a total reduction not to exceed 75%.

14. The process of claim 2 wherein said cold rolling of said strip to said final gauge comprises a total reduction not to exceed 70%.

15. The process of claim 2 wherein said flash anneal comprises a heat up time not to exceed 30 seconds, holding the strip at temperature for between about 3 to 30 seconds and cooling the strip to room temperature with 25 seconds.

16. The process of claim 15 wherein said heat up is preferably between 4 to 15 seconds.

17. The process of claim 2 wherein said cold rolling to said final gauge comprises a total reduction of from about 65% to 70%.

18. A process for fabricating high strength, improved formability low earing aluminum strip stock from hot rolled aluminum strip comprising:

(A) cold rolling said hot rolled strip in a first series of passes to an intermediate gauge;

(B) flash annealing said cold rolled strip for not more than 90 seconds at a temperature of from about 350° C. to 500° C.; and (C) cold rolling said flash annealed strip in a second series of passes to final gauge.

19. The process of claim 18 wherein said cold rolling to said intermediate gauge comprises at least a 50% reduction in thickness.

20. The process of claim 18 wherein said cold rolling to said final gauge comprises a total reduction of at least 65%.

21. The process of claim 18 wherein said cold rolling to said final gauge comprises a total reduction not to exceed 75%.

22. The process of claim 18 wherein said cold rolling of said strip to said final gauge comprises a total reduction not to exceed 70%.

23. The process of claim 18 wherein said flash anneal comprises a heat up time not to exceed 30 seconds, holding the strip at temperature for between 3 to 30 seconds and cooling the strip to room temperature within 25 seconds.

24. The process of claim 23 wherein said heat up is preferably between 4 to 15 seconds.

25. The process of claim 18 wherein said cold rolling to said final gauge comprises a total reduction of from about 65% to 70%.

26. A multi-stepped process for fabricating high strength, improved formability, low earing aluminum strip block from an aluminum melt comprising:

(A) continuously casting said aluminum melt in strip form;

(B) holding said cast strip at casting speed after the start of solidification at a temperature between 400° C. and the liquidus temperature of the alloy for about 2 to 15 minutes so as to obtain a preferred dendritic arm spacing;

(C) continuously hot rolling said cast strip at casting speed at a temperature range between 300° C. and the non-equilibrium solidus temperature of the alloy to a total reduction of at least 70%, the temperature of the strip At the start of hot rolling being between said non-equilibrium solidus temperature and a temperature of about 150° below said non-equilibrium solidus temperature wherein the temperature of the strip at the end of hot rolling is at least 280° C.;

(D) immediately hot coiling said hot rolled strip wherein said coiled strip is allowed to cool in air to room temperature;

(E) cold rolling said cooled hot rolled strip in a first series of passes to an intermediate gauge of at least 50% reduction in thickness;

(F) flash annealing said cold rolled strip for not more than 90 seconds at a temperature of from about 350° C. to about 500° C.; and (G) cold rolling said annealed strip in a second series of passes to a final gauge having a total reduction of at least 65%.

UNITED STATES PATENT AND TRADEMARK OFFICE

CERTIFICATE OF CORRECTION

PATENT NO. : 4,238,248

DATED : December 9, 1980

INVENTOR(S) : Ivan Gyongyos et al.

It is certified that error appears in the above-identified patent and that said Letters Patent are hereby corrected as shown below:

In Column 3, lines 15-16, change "improve" to --improves--.

In Column 4, line 55, change "dentritic" to read --dendritic--.

In Column 8, line 7, change "E" to --B--.

In Column 8, line 67, change "the" to --this--.

In Column 9, line 17, insert --EXAMPLE IV--.

In Column 10, line 30, claim 2, change "soldius" to --solidus--.

In Column 10, line 61, claim 4, change "alumnum" to --aluminum--.

In Column 11, line 66, claim 15, change "with" to --within--.

In Column 12, line 5, claim 18, after "formability" insert --,--.

In Column 12, line 28, claim 23, after "between" insert --about--.

UNITED STATES PATENT AND TRADEMARK OFFICE

CERTIFICATE OF CORRECTION

PATENT NO. : 4,238,248

DATED : December 9, 1980

INVENTOR(S) : Ivan Gyongyos et al.

It is certified that error appears in the above-identified patent and that said Letters Patent are hereby corrected as shown below:

In Column 12, line 39, claim 26, change "block" to --stock--.

In Column 12, line 51, claim 26, change "At" to --at--.

Signed and Sealed this

*Fourteenth* Day of *July 1981*

[SEAL]

*Attest:*

GERALD J. MOSSINGHOFF

*Attesting Officer*

*Commissioner of Patents and Trademarks*